US006746307B2

(12) United States Patent
Knoll et al.

(10) Patent No.: US 6,746,307 B2
(45) Date of Patent: Jun. 8, 2004

(54) METHOD FOR RE-PROFILING AT LEAST ONE RUNNING SURFACE OF A RAIL, AND CORRESPONDING DEVICE

(75) Inventors: Johann Knoll, Schörfling (AT); Walter Neubauer, Ohlsdorf (AT)

(73) Assignee: Linsinger Maschinenbau Gesellschaft, m.b.H., Steyrermühl (AT)

( * ) Notice: Subject to any disclaimer, the term of this patent is extended or adjusted under 35 U.S.C. 154(b) by 0 days.

(21) Appl. No.: 10/345,139

(22) Filed: Jan. 16, 2003

(65) Prior Publication Data

US 2003/0129926 A1 Jul. 10, 2003

Related U.S. Application Data

(63) Continuation of application No. PCT/AT01/00234, filed on Jul. 12, 2001.

(30) Foreign Application Priority Data

Jul. 17, 2000 (AT) ..... 1241/2000

(51) Int. Cl.[7] ..... B24B 49/00; B24B 51/00; B24B 23/00

(52) U.S. Cl. ..... 451/5; 451/49; 451/56; 451/69; 451/57; 451/347

(58) Field of Search ..... 451/49, 65, 67, 451/69, 347, 56, 72, 66, 57, 58, 5; 15/54, 55; 409/141, 178

(56) References Cited

U.S. PATENT DOCUMENTS 4,908,993 A * 3/1990 Buhler ..... 451/347
4,951,424 A * 8/1990 Buhler ..... 451/347
5,265,379 A * 11/1993 Panetti ..... 451/11
5,997,391 A * 12/1999 Jaeggi ..... 451/429

* cited by examiner

*Primary Examiner*—Timothy V. Eley
(74) *Attorney, Agent, or Firm*—Dickstein Shapiro Morin & Oshinsky, LLP

(57) ABSTRACT

The invention relates to a method for re-profiling the running surface of a rail, preferably the convex portion of the rail head cross-profile of a rail, especially a railway rail, by peripheral milling. The aim of the invention is to obtain a profile that meets the requirements and has few corrugations. To this end, for producing the profile in a single peripheral grinding step, more than five, preferably nine milling tracks are produced that are oriented in parallel to the longitudinal direction of the rail. Optionally, the running surface, preferably the convex portion of the rail head cross-profile including the running surface is ground afterwards.

28 Claims, 6 Drawing Sheets

1
2
3
7
8
9
10
11
12
13
14
15
16
17
18
19
20
21
22
23
24
II
α

30
31
30
31
31
30
35
VIII
32
32

33
34
30

METHOD FOR RE-PROFILING AT LEAST ONE RUNNING SURFACE OF A RAIL, AND CORRESPONDING DEVICE

This application is a continuation of international application number PCT/AT 01/00234 filed Jul. 12, 2001.

The invention relates to a method for re-profiling by peripheral milling at least one running surface of a rail, preferably the convex portion of the rail head cross-profile of a rail, especially a railway rail, which convex portion exhibits the running surface.

It is known to re-profile worn rails by peripheral milling, i.e. to provide them with a new profile. For that purpose, the rail head was machined by peripheral milling. In order to somewhat control the costs of a milling cutter, it is known to equip the milling cutter with turning plates mounted to holding devices in turn inserted in recesses in the milling cutter body. In doing so, the turning plates being on a level of the peripheral milling cutter each generate a milling track oriented in the longitudinal direction of the rail. However, for lack of space, the number of turning plates to be attached is limited with peripheral milling cutters of that kind. Therefore, by peripheral milling it was only possible to provide a small number of tracks lying next to each other in the longitudinal direction of the rail and being applied to the rail head by the turning plates. Thereby, a large corrugation is created, and it was necessary to subject the rail head to a smoothing process following upon milling. It is known to equip a peripheral milling cutter for that purpose with a plurality of blades exhibiting the entire desired profile. The plurality of blades is necessary in so far as they ensure that only slight differences in depth occur in the longitudinal direction of the rail. Here, it is disadvantageous that the hollows and points generated by such kind of smoothing extend across the entire cross section that is machined. That causes noise and vibrations when being passed over as well as a decrease in lifetime.

The invention aims at avoiding those drawbacks and difficulties and has as its object to provide a method of the initially described kind as well as a rail-profile milling cutter for carrying out the method, by means of which it is possible to achieve a minor corrugation both in the longitudinal direction of the rails and in the cross-profile which complies with the regulations of the railway operators or the railway corporations. The present invention employs a milling operation that—for less stringent regulation requirements, such as for slower speeds of the railway—may suffice alone. To meet more stringent requirements, such as for faster speeds of the railway, an optionally subsequent grinding operation may be employed.

In a method of the initially described kind that object is achieved in that, in order to produce the desired profile by a single peripheral milling operation, more than five, preferably nine, milling tracks lying next to each other in the longitudinal direction of the rail are formed and that, in the following, optionally a grinding operation of at least the running surface, preferably the convex portion of the rail head cross-profile, which convex portion exhibits the running surface, is carried out.

Preferred variants are characterized in the subordinate claims.

As mentioned above, for railways having greater requirements such as, faster traveling speeds, the milling operation, according to the invention, is followed by a grinding operation. Thus, in order to decrease or level the corrugation running in the longitudinal direction of the tracks and, optionally, in order to flatten or level the polygonal line (cross-section), respectively, the milled rail is ground, preferably immediately following upon milling taking place in the same run. The axis of the grinding wheel and a plane perpendicular to the longitudinal direction of the rail includes an angle deviating from 0°. Preferred variants for said grinding are described in the following detailed description of the invention.

A rail-profile milling cutter according to the invention is provided for milling at least one running surface of a rail, especially a railway rail, preferably for milling the convex portion of a rail head cross-profile of a rail. The rail-profile milling cutter is a sandwich milling cutter configured with a plurality of wheels each of which is provided with turning plates at the periphery of the wheels.

Advantageous embodiments are described below

A device for carrying out the method according to the invention is characterized by

- a means for generating a relative motion between the rail and the milling cutter as well as the optionally existing grinding wheel,
- a driving means for the milling cutter as well as a driving means for the grinding wheel in case a grinding wheel is provided,
- a milling cutter formed of a plurality of wheels provided with turning plates at the periphery,
- a positioning of the axis of the grinding wheel in a direction deviating from a plane perpendicular to the longitudinal direction of the rail.

BRIEF DESCRIPTION OF THE DRAWINGS

In the following, the invention is explained in more detail by way of two exemplary embodiments with reference to the drawings, wherein.

Figures 6, 7:
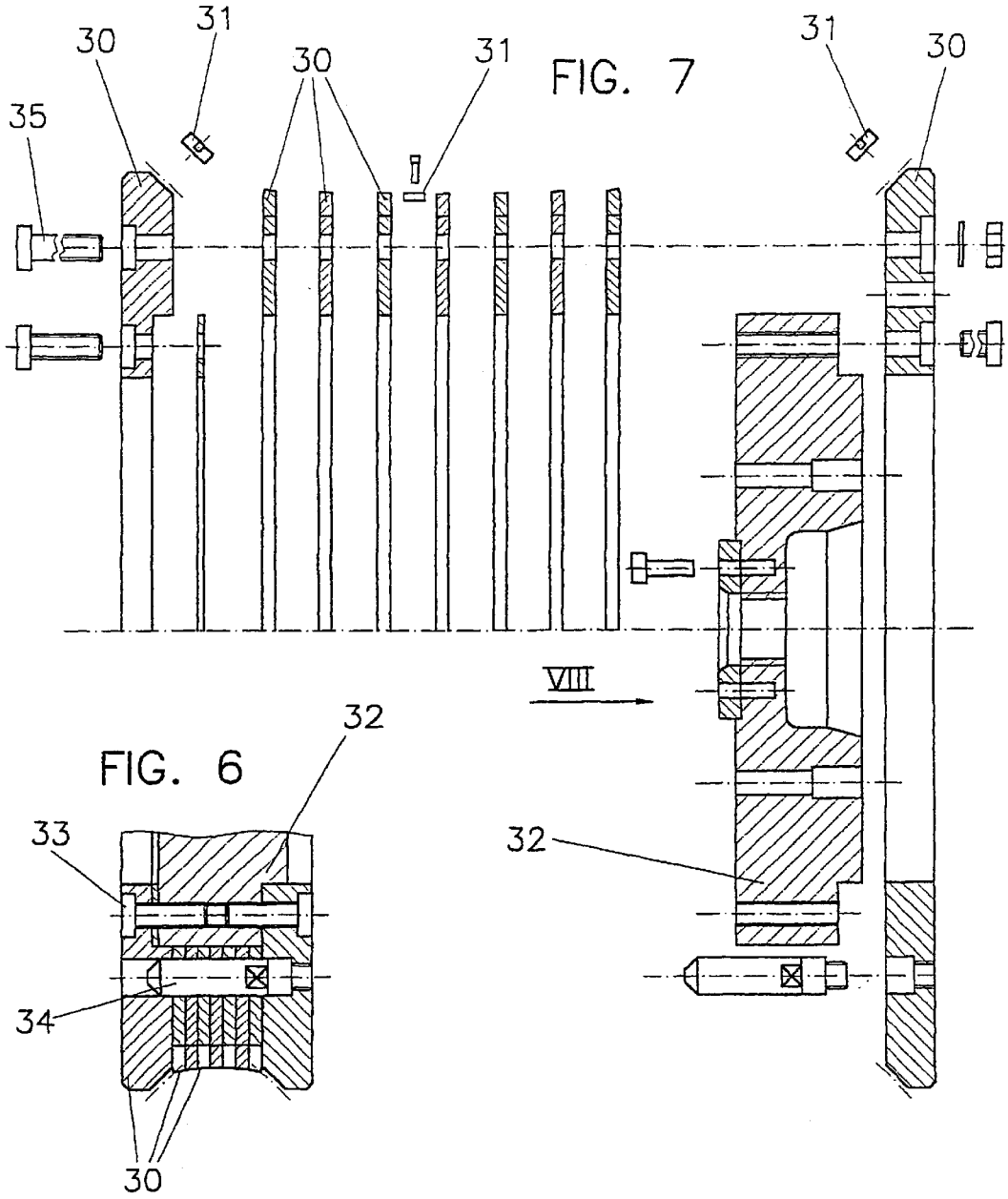
Figure 8:
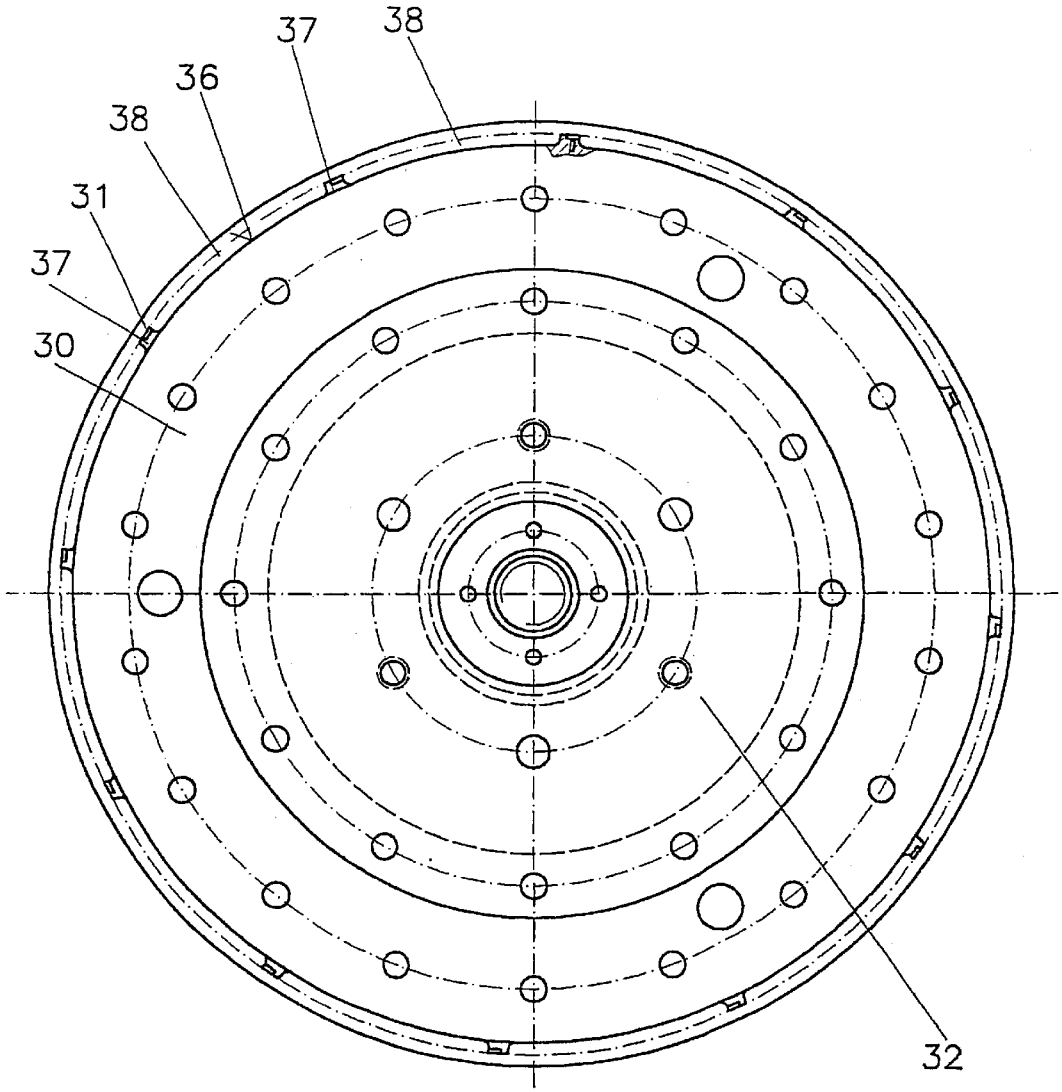

The rail-profile milling cutter according to the invention is shown in FIGS. 6 to 8, with FIG. 6 illustrating a partial section through the milling cutter in the assembled state, FIG. 7 illustrating the individual parts of the milling cutter in an exploded view, and FIG. 8 being a side view of a wheel of the milling cutter along the arrow VIII of FIG. 7.

DETAILED DESCRIPTION OF THE INVENTION

Figure 4:
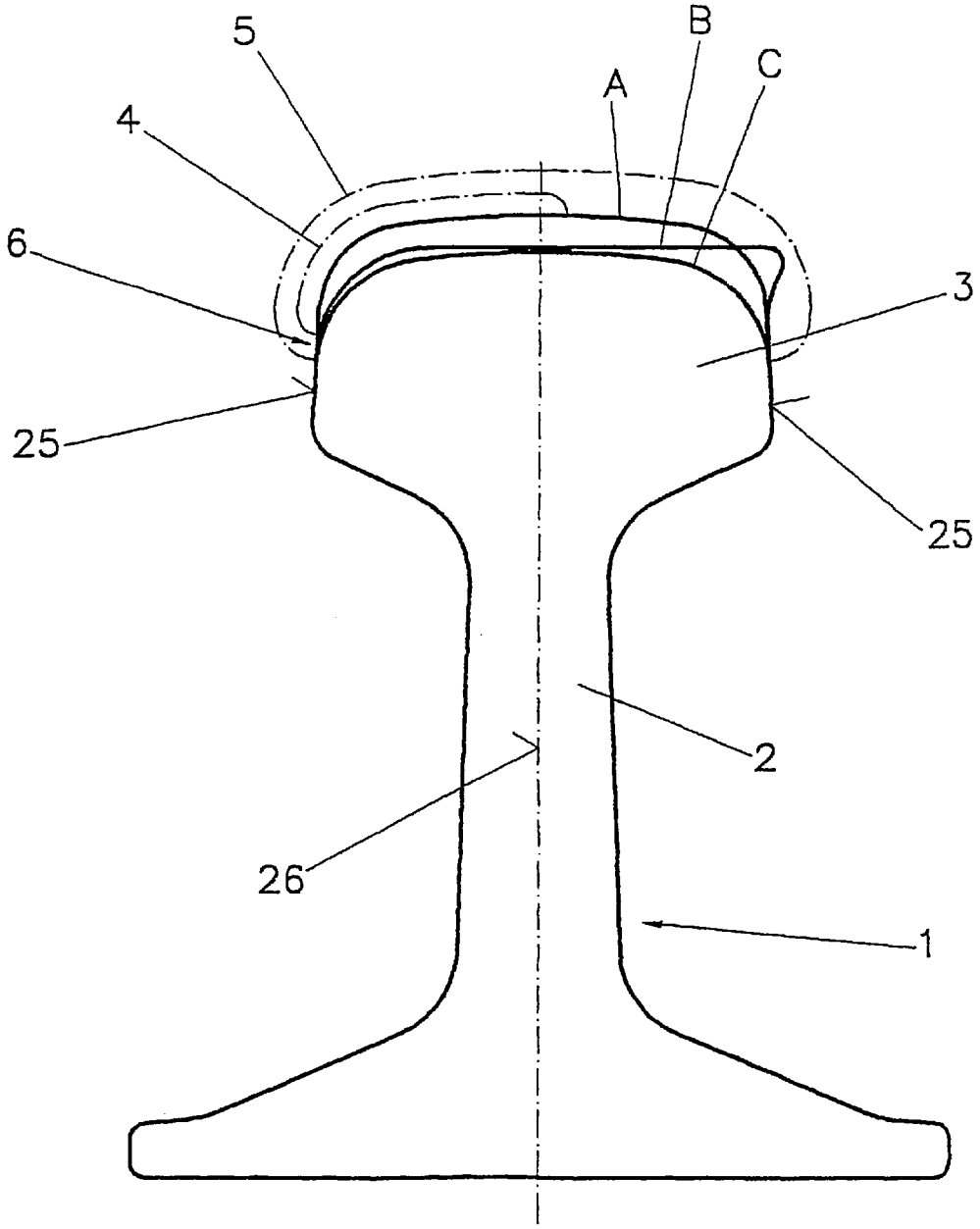
FIG. 4 shows the cross section of a railway rail in various conditions of the rail.

In FIG. 4, the cross section of a rail 1 is illustrated in various conditions. The rail head 3 situated on the stem of a rail 2 is provided with a convex cross-sectional portion 5 exhibiting the running surface 4 on which the track wheel of a rail vehicle runs, which cross-sectional portion, in its new condition, is illustrated by line A. Due to wear, that convex portion 5 of the cross section of the rail head 3 receives the shape as illustrated by line B. As soon as rail 1 has reached that condition or even earlier, as in accordance with high-speed rails, rail 1 is subjected to finishing so that the convex portion 5 of the rail head 3, at least, however, the running surface 4, regains its original condition, i.e. the original cross-sectional shape—as illustrated by line C—with the best possible approximation in accuracy. Thereby, certain tolerances in the range of from 1 to 3 decimillimeters are to be observed according to the regulations of a railway operator or a railway corporation or a supraregional standard such as cen DRAFT pr EN 13674–1. In doing so, it is essential that the guiding surface 6 of the rail 1 and the running surface 4 are finished.

As can be seen in FIG. 4, a relatively large amount of material has to be removed according to the wear of the rail, which has to be done as fast and inexpensively as possible in case of laid rails so as to impede the railway traffic as little as possible.

Figures 1, 2:
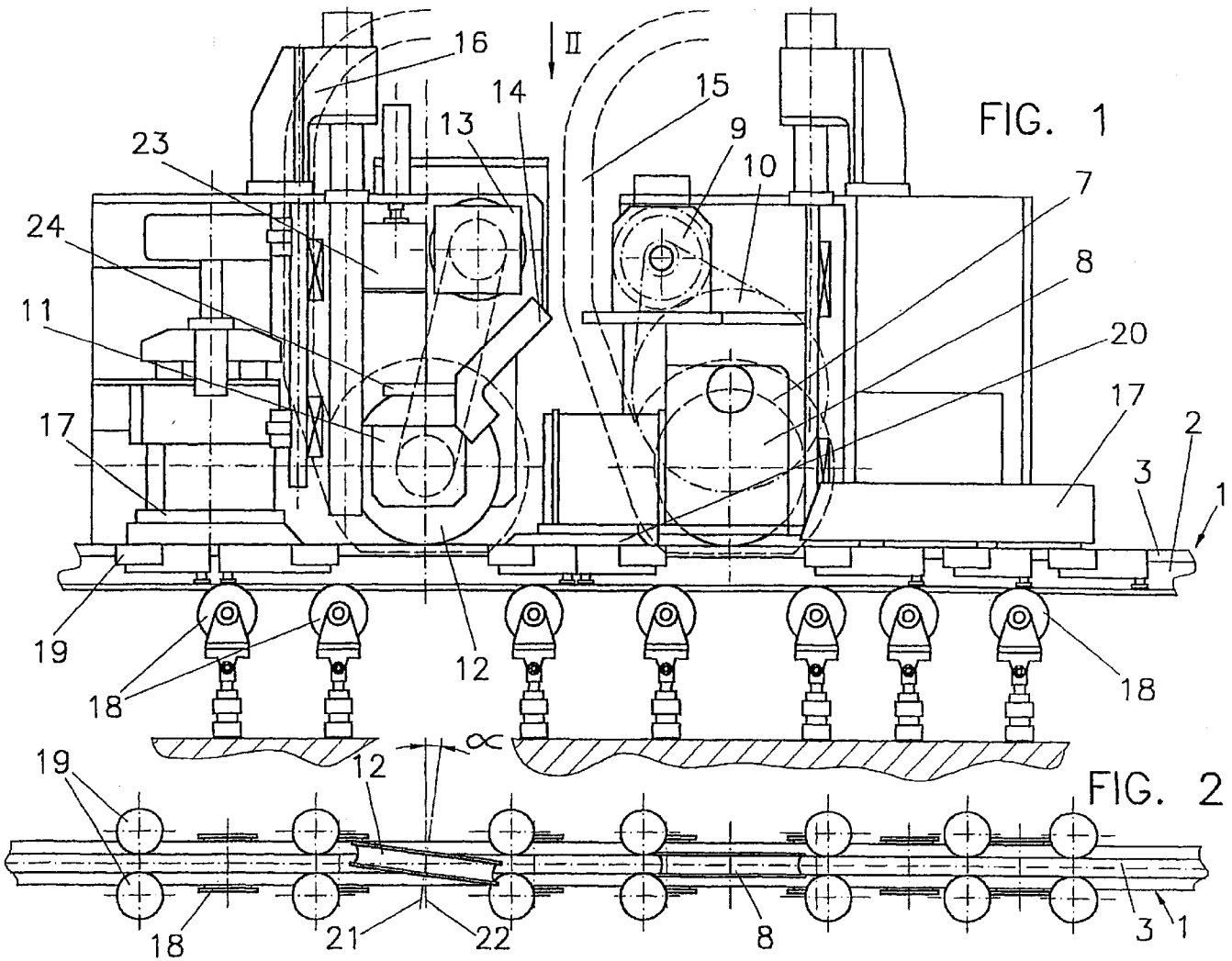
FIG. 1 shows a side view of a device for carrying out the method according to the invention and FIG. 2 shows a schematic top view along the arrow II of FIG. 1.
Figure 3:
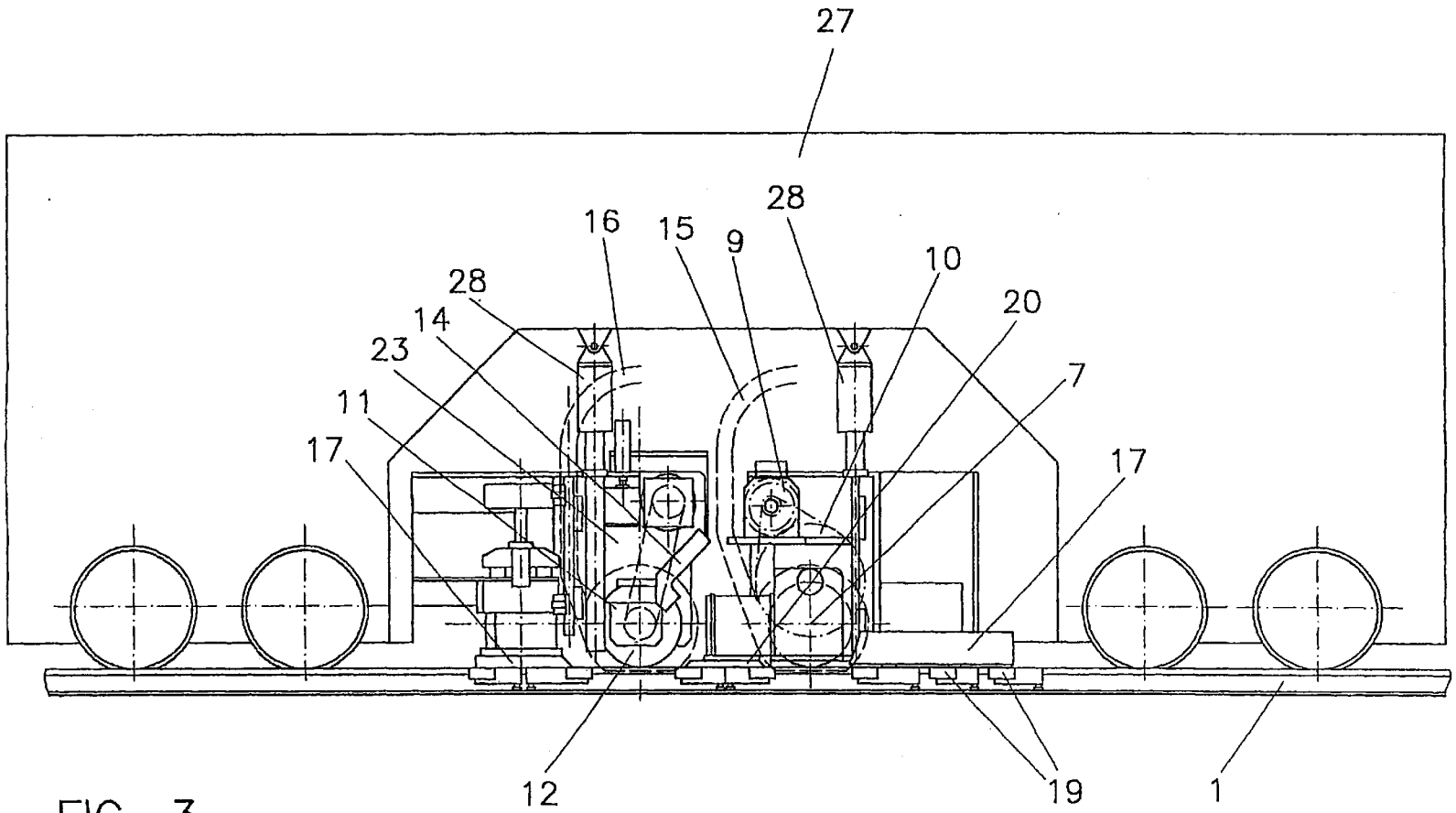
FIG. 3 shows a variant of the device for carrying out the method according to the invention.

FIGS. 1 and 2 illustrate a device according to the invention which is arranged in a stationary position and past which the rail 1 to be machined is moved. FIG. 3 illustrates a device according to the invention which is incorporated in a movable facility such as a locomotive engine so that it is feasible to machine rails which already have been laid by means of said device. In that case, the device according to the invention exists in duplicate so that both the left-hand and the right-hand rails can be finished in one passage. Parts and devices of the stationary facility and the movable device which are mutually identical are marked by identical numerals.

Reference numeral 7 denotes a milling unit the rail-profile miffing cutter 8 of which is configured as a peripheral miffing cutter and is described in greater detail hereinafter. The milling cutter 8 can be driven via a driving motor 9 and a gear 10 whereby the direction of rotation is chosen such that the rail 1 is machined by the cut-down milling method. Immediately adjacent to the milling unit 7, a grinding unit 11 is provided, the grinding wheel 12 of which can be driven by means of a driving gear 13, preferably also in the direction of rotation of the milling cutter 8 so that down-grinding of the rail 1 is effected. The grinding wheel 12 is equipped with a system for regulating the depth of grinding 14 so that it is feasible to continuously readjust the grinding wheel 12 to the rail 1, according to its wear. The Said system for regulating the depth of grinding 14 comprises a measuring system for measuring the continuously decreasing diameter of the periphery of the grinding wheel 12; it can also make use of measuring data gained from measuring an angular moment of a driving component.

Just upon their emergence, both the milling chips and the grinding chips as well as the grinding dust are removed via the vacuum means 15 and 16.

Just in front of the milling unit 7 and just behind the grinding unit 11, guides 17 for the rail 1 are provided in each case, against which guides the rail 1 can be pressed by means of support rolls 18, whereby it is possible to press at least the running surface 4 of the rail 1, preferably the crown of the rail head 3. Furthermore, lateral guiding rolls 19 engaging the rail head 3 on both sides are provided along the device, whereby the lateral guiding rolls 19 fitting closely to the side of the guiding surface 6 of the rail 1 are fixed in their positions. The rail is pressed against the fixed lateral guiding rolls 19 by the lateral guiding rolls 19 fitting closely to the opposite side, whereby the rail 1 assumes an exact position opposite the milling unit and the grinding unit.

Between the milling unit 7 and the grinding unit 11, a further guide 20 is provided, which is equipped with a damping device in order to eliminate any vibrations of the rail 1 caused by the milling cutter.

As can be seen in particular in FIG. 2, the axis 21 of the grinding wheel is inclined by an angle $\alpha$ against a plane 22 perpendicular to the longitudinal direction of the rail, which angle is greater than 0, preferably ranging between 1 and 20° C., depending on the respective condition of the rail 1 prior to grinding. If the rail head 3 has a cross section which, due to milling, approaches the ideal cross section, already before grinding, or if the rail 1, in its new condition, is still provided with a roller skin, the angle $\alpha$ suitably ranges between 5 and 12°, ideally amounting to 8°. However, if the previous state of the cross section has been adjusted to the ideal cross-profile in a less exact manner, f.i., if it has been roughed down only crudely, a smaller angle $\alpha$, preferably ranging between 1 and 6° C., is suitable for securing an optimal chip removal volume with a long service life of the grinding wheel.

In its new condition, the grinding wheel 12 has already been pre-profiled, i.e., it exhibits a profile which roughly mates rail 1. For an exact manufacture of said counterprofile, it is advantageous to provide a sharpening means 23 with a grinding stone 24 which can be pressed against the periphery of the grinding wheel 12. Said grinding stone has exactly the desired profile which is to be produced and it also includes angle $\alpha$ together with the grinding wheel. Before grinding of the first rail 1 is started, said grinding stone 24 is pressed against the grinding wheel 12 until the grinding wheel has adopted its profile. While rail 1 is ground, the grinding stone 24 can be lifted from the grinding wheel 12, since the grinding wheel profiles itself at the pre-profile, i.e., at the milled rail-head area or the rail-head surface still provided with the roller skin, respectively. During machining of a rail head 3, the grinding stone may optionally be fitted to the grinding wheel 12 for temporary sharpening.

Rail 1 may also be used for the adjustment of a profile which exactly mates the grinding wheel 12 provided that it has been milled with sufficient accuracy or still has the roller skin.

If, as in the illustrated exemplary embodiment, a milled rail-head surface is ground, the profiled grinding wheel 12 only has the most important task of smoothing the waves generated by the milling cutter 8 and of creating an image of traverse grinding.

Figure 5:
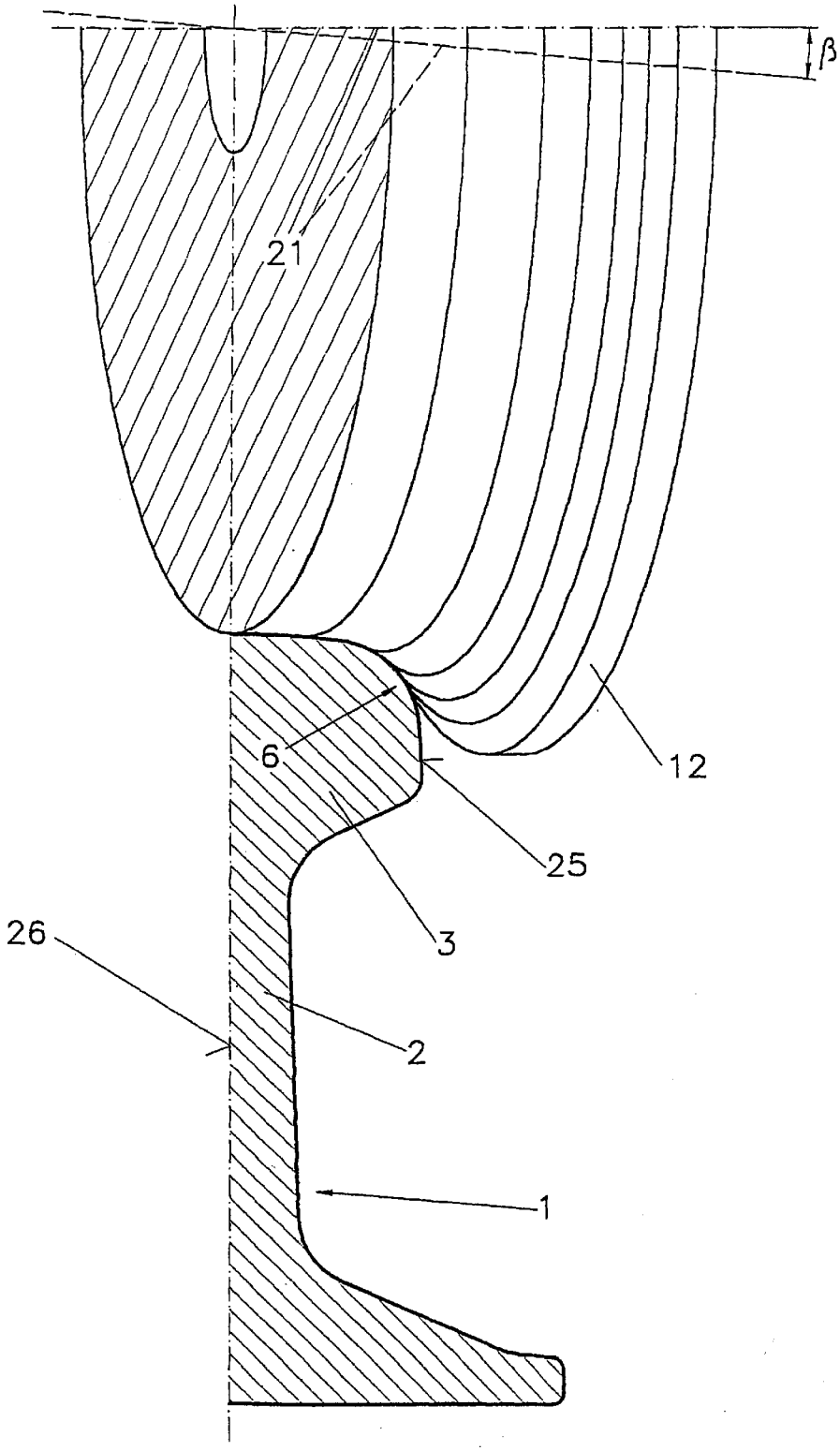
FIG. 5 shows the engagement of the grinding wheel on a railway rail seen in cross section, in accordance with the method according to the invention.

By inclining the grinding wheel 12 according to the invention, particularly good conditions of engagement as well as a strong smoothing effect occur. The engagement of the inclined grinding wheel 12 is illustrated in FIG. 5. It is apparent that the inclination creates an advantageous engagement angle, in particular at the point where the convex portion 5 of the rail head 3 meets the side faces 25 of the rail head 3. Those favourable conditions of engagement allow also in those places a sufficiently extensive removal of material with a very good thermal behaviour being provided so that, on the ground surface, burning cannot occur. Furthermore, a very good service life of the grinding wheel 12 is thereby created.

It can be advantageous if the axis 21 of the grinding wheel 12 is also inclined against the rail's longitudinal central plane of symmetry 26 by an angle $\beta$ which may have a size of between 1 and 20°.

If different rail profiles are to be machined by means of the device according to the invention, the axis 21 of the grinding wheel 12 may suitably be arranged so as to be adjustable on the device.

According to the embodiment illustrated in FIG. 3, the milling unit 7 and the grinding unit 11 are incorporated in a rail-milling line 27. By means of actuators 28, the milling cutter 8 and the grinding wheel 12 are moved approximately vertically against the rail 1 until the guides 17 and 20 rest on the rail head 3. A lateral movement of the grinding unit 11 and the milling unit 7 toward the guiding surface 6 until the lateral guiding rolls 19 rest on the rail head 3 is possible as well.

The rail-profile milling cutter 8 according to the invention is constructed as a sandwich milling cutter, i.e., it is comprised of wheels 30 each of which is shaped as a ring wheel. As will be described hereinafter, those ring wheels 30 each support a plurality of turning plates 31. These are made of hard metals, ceramics or similar materials. As can be seen in FIG. 6, the ring wheels 30 are fastened to a milling cutter core 32 by means of a screw connection 33 and are centered against each other by means of several centering pins 34 and are secured against each other by means of further screws 35.

According to the illustrated exemplary embodiment, nine ring wheels 30 are provided, whereby the two external ring wheels 30 support quadruple turning plates the cutting edges of which are of an arcuated shape and serve for milling, i.e. creating a milling track, close to the guiding surface 6. At the outer periphery 36, the ring wheels 30 arranged between the external ring wheels 30 are provided with humps 37 surpassing the outer periphery 36 and manufactured in one piece with the ring wheels 30. Said humps 37 form seats for the quadruple turning plates 31, which, however, exhibit straight cutting edges. Due to the humps 37 provided at the ring wheels 30, spacious chip bags 38 are formed between the turning plates 31.

All turning plates 31 are fastened to the ring wheels 30 preferably by means of screw connections, clamping joints might be used as well. Each of the cutting edges of the turning plates 31 of the ring wheels 30 arranged between the external ring wheels 30 surpasses with its cutting edge the side faces of the ring wheel 30 to which it is fastened. The turning plates 31 of adjacent ring wheels 30, which turning plates are arranged on the ring wheels 30, are arranged so as to be peripherally offset so that, with respect to the periphery, the turning plates 31 of the neighbouring ring wheel end up lying between the turning plates 31 of the first ring wheel 30.

By means of the sandwich milling cutter 8 according to the invention, it is possible to mill a great number of milling tracks—even more than nine—extending in the longitudinal direction of the rail 1 onto the rail head 3, whereby it is feasible to achieve an extremely great accuracy of the milled cross-profile, i.e., an extremely close approximation to the ideal cross-profile of the rail head 3. For certain requirements, the rail heads 3 re-profiled by means of the milling cutter 8 according to the invention and/or the milling method according to the invention are sufficient without subsequent grinding being necessary, f.i., for travelling speeds which are not too high. For greater requirements, the milled tracks are subjected to a grinding operation such as described above.

The essential advantage of the grinding method according to the invention lies in the plurality of adjacent milling tracks which can be milled onto the rail head 3 in a single working process. Particularly advantageously, the milling method according to the invention is combined with the grinding method according to the invention, whereby it is feasible to achieve an extensive removal of material also in case of extremely worn rails as well as a surface which, because of the milling method according to the invention, corresponds to the desired rail profile already to a large extent and which requires only minor grinding, i.e., grinding involving the removal of relatively little material, if any.

In doing so, it is possible to combine milling and grinding in a single operating process, thereby manufacturing a running surface or a machined portion of the rail head, respectively, fulfilling the greatest requirements in terms of running qualities, lifetime and avoidance of noise.

What is claimed is:

1. A method for re-profiling by peripheral milling at least one running surface of a rail, the rail including a rail head having a convex portion that exhibits the running surface, the method comprising the step of forming, in a single peripheral milling operation, more than five milling tracks lying next to each other in the longitudinal direction of the rail.

2. A method according to claim 1, wherein the milling tracks include two external milling tracks that define a curved line in cross section and the tracks between the two external tracks define a straight line in cross section so that the rail head has a cross-profile between the external tracks which is configured as a polygonal line.

3. A method according to claim 1, wherein the milling tracks have corrugations running in the longitudinal direction of the rail, the corrugations being arranged so as to be mutually offset so that valleys and peaks of a track end up as offset in the longitudinal direction against the valleys and peaks of adjacent tracks.

4. A method according to claim 1, wherein the milling of the tracks is carried out by a cut-down milling method.

5. A method according to claim 1, smooth the rail in the longitudinal direction of the tracks and in order to flatten a polygonal line, the milled rail is ground with a grinding wheel, with the axis of the grinding wheel being inclined with respect to a plane perpendicular to the longitudinal direction of the rail at an angle deviating from 0°.

6. A method according to claim 5, wherein the axis of the grinding wheel is inclined with respect to the plane perpendicular to the longitudinal direction of the rail at an angle $\alpha$ of between 1 and 20°.

7. A method according to claim 6, wherein the angle $\alpha$ ranges between 5 and 12°.

8. A method according to claim 7, wherein the angle $\alpha$ is about 8°.

9. A method according to claim 5, wherein the axis of the grinding wheel is inclined with respect to a plane of symmetry lying in the longitudinal direction of the rail at an angle $\beta$ of about 90°.

10. A method according to claim 8, wherein the grinding wheel is profiled by means of a grinding stone, the grinding stone exhibiting the profile of the running surface of the rail, and the grinding stone being inclined at the same angles $\alpha$ and $\beta$ as the grinding wheel.

11. A method according to claim 5, wherein the axis of the grinding wheel is inclined with respect to a plane of symmetry lying in the longitudinal direction of the rail at an angle $\beta$ smaller than 90° and greater than 70°, with said angle $\beta$ being maintained on the side of a guiding surface of the rail.

12. A method according claim 5, wherein the grinding wheel is continuously readjusted, in the direction toward the rail, to regulate the depth of grinding.

13. A method according to claim 12, wherein the depth of grinding is regulated based upon measuring data gained from measuring the diameter of the grinding wheel surface or based upon measuring data gained from measuring the moment of driving of the grinding wheel.

14. A method according to claim 5, wherein the grinding wheel is profiled by means of a grinding stone, whereby the grinding stone exhibits the profile of at least the running surface of the rail.

15. A method according to claim 14, wherein profiling of the grinding wheel takes place before grinding of the running surface of the rail is started and, subsequently, during grinding, profiling is carried out periodically.

16. A method according to claim 5, wherein relative longitudinal motion between a rail and the milling cutter as well as the grinding wheel is generated by longitudinally displacing the rail relative to the milling cutter and the grinding wheel.

17. A method according to claim 16, wherein, immediately before the engagement of the milling cutter and immediately before the engagement of the grinding wheel, the rail in each case is pressed against a guide directed against the running surface of the rail.

18. A method according to claim 17, wherein the guide is damped in order to avoid vibrations.

19. A method according to claim 16, wherein, immediately before the engagement of the milling cutter and immediately before the engagement of the grinding wheel, the rail is pressed against a lateral guide directed against the guiding surface of the rail.

20. A method according to claim 16, wherein, immediately upon the engagement of the grinding wheel, the rail is pressed against a guide directed toward the running surface of the rail.

21. A method according to claim 16, wherein, immediately upon the engagement of the grinding wheel, the rail is pressed against a lateral guide directed against a guiding surface of the rail.

22. A method according to claim 5, wherein milling and grinding chips are removed immediately.

23. A method according to claim 5, wherein the grinding is carried out by a cut-down method.

24. A method according to claim 5, wherein the rail is a laid rail, and relative longitudinal motion between the rail and a milling cutter as well as the grinding wheel is performed by longitudinally moving the milling cutter and the grinding wheel along the laid rail.

25. A method according to claim 24, wherein the milling cutter as well as the grinding wheel are moved against the rail up to a point of engagement, whereby the movement is restricted in each case by means of a guide which can be pressed against the running surface of the rail.

26. A method according to claim 25, wherein the movement is restricted independently of a system for regulating a depth of grinding.

27. A method according to claim 24, wherein the milling cutter and the grinding wheel are movable in the a direction against the a guiding surface of the rail, which movement is restricted by means of a guide directed against the guiding surface of the rail.

28. A method according to claim 5, wherein the grinding step takes place immediately upon milling taking place.

* * * * *